United States Patent [19]

Lesse

[11] Patent Number: 4,905,927

[45] Date of Patent: Mar. 6, 1990

[54] UNWINDING ARRANGEMENT

[75] Inventor: Håkan Lesse, Södra Sandby, Sweden

[73] Assignee: Aktiebolaget Profor, Lund, Sweden

[21] Appl. No.: 260,076

[22] Filed: Oct. 20, 1988

[30] Foreign Application Priority Data

Nov. 3, 1987 [SE] Sweden ..... 87042834

[51] Int. Cl.[4] ..... B65H 59/38

[52] U.S. Cl. ..... 242/75.43; 242/156.2

[58] Field of Search ..... 242/75.43, 156, 156.2, 242/75.44, 75.4

[56] References Cited

U.S. PATENT DOCUMENTS 3,618,870 11/1971 Martin ..... 242/156.2 X 4,669,686 6/1987 Huber et al. ..... 242/75.4 X

*Primary Examiner*—Daniel P. Stodola

*Assistant Examiner*—Steven M. DuBois

*Attorney, Agent, or Firm*—Burns, Doane, Swecker & Mathis

[57] ABSTRACT

Unwinding arrangements for material webs which are consumed continuously by such as packing machines which machines are provided frequently with an arrangement which brakes the roll so that it does not continue to rotate when the unwinding ceases. To make possible well adapted braking, the unwinding arrangement in accordance with the invention, is provided with a maneuvering arm adapted to be acted upon by the material, which, in the event of changes in the web tension, presses with a varying force a rotatable braking appliance against a brake drum combined with the material roll.

11 Claims, 2 Drawing Sheets

UNWINDING ARRANGEMENT

BACKGROUND OF THE INVENTION

The present invention relates to unwinding arrangements for weblike material.

On unwinding a weblike material such as a packing material web, packing material strip or any other flexible, elongated material from a roll, it is of great importance that the roll rotates in such a manner that exaggerated tractive stresses or jerks are not applied to the material. In the case of large material rolls of appreciable dimensions and weight, brakes of the electrical or hydraulic type are used which are controlled in such a manner that the unwinding resistance during the whole time is kept at a suitable level. With smaller, relatively light rolls, e.g. material strips, it is customary for reasons of cost to use relatively simple devices. Such a device may be a friction brake in contact with the roll which may have a lever which acts upon the outgoing material strip so that the braking force increases when the tractive stress in the material strip diminishes. Such an arrangement is used in the unwinding of so-called longitudinally jointed strips of plastics on packing machines of the type which convert a tube made of packing material to individual packing containers. This arrangement comprises a brake appliance of rubber resting against the peripheral edge of the roll, which in the case of small rolls and a relatively uniform rate of unwinding, provides the required braking, but cannot function satisfactorily with heavier rolls and varying rate of unwinding. This design, moreover, has the disadvantage that the wear on the rubber surface of the brake appliance is relatively high which may cause fouling, requires frequent replacement of the brake appliance.

SUMMARY OF THE INVENTION

It is an object of the present invention to provide an unwinding arrangement having a brake of such a design that the aforementioned disadvantages are avoided without the brake arrangement for this reason becoming technically complicated and expensive.

It is a further object of the present invention to provide an unwinding arrangement comprising a brake arrangement which without appreciable wear supplies uniform and constant braking, in case of a varying rate of unwinding, and which subjects the material strip to minimum forces and stresses.

It is a further object of the present invention to provide an unwinding arrangement which, in the case of relatively large and heavy rolls, supplies rapid and effective braking when the tractive force in the material web ceases.

These and other objects have been achieved in accordance with the invention in that an unwinding arrangement for weblike material comprising a roll stand and a brake arrangement with a maneuvering arm adapted to be acted upon by the material web has been given the characteristic that the maneuvering arm has a rotatable brake appliance which, through maneuvering of the arm, can be pressed against a brake drum which is rotatable during the unwinding of the material.

Preferred embodiments of the arrangement in accordance with the invention have been given, moreover, the characteristics which are evident from the subsidiary claims.

The unwinding arrangement in accordance with the invention, irrespective of a simple and relatively inexpensive design, supplies an effective brake force well adapted to the tractive force in the material strip which makes it possible to unwind even thin and delicate types of strip from large rolls without any risk of rupture or extension. The arrangement is particularly suitable for use in packing machines of the type which in the continuous manufacture of packing containers from a packing material web at varying speed consume a longitudinally jointed strip of thin plastic material. The wear on the arrangement is very low, and the arrangement in general requires little maintenance.

DESCRIPTION OF THE DRAWINGS

A preferred embodiment of the arrangement in accordance with the invention will now be described in more detail with special reference to the attached drawings which only show the details indispensable for an understanding of the invention.

DETAILED DESCRIPTION

Figure 1:
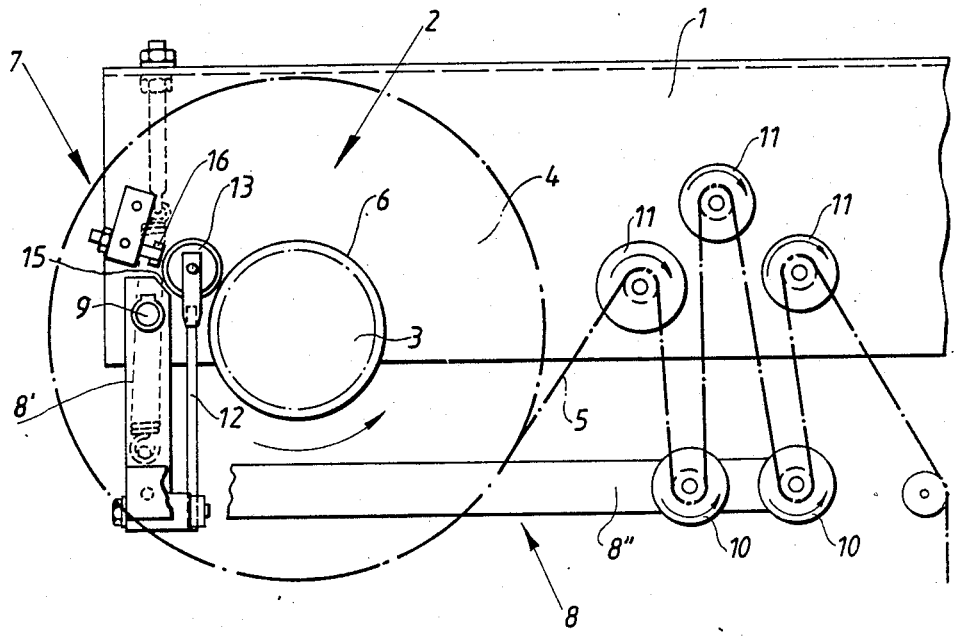
FIG. 1 shows the unwinding arrangement in accordance with the invention from the side, with certain parts, for the sake of clarity, being indicated only by dash-dotted contour lines.

The preferred embodiment of the unwinding arrangement in accordance with the invention which is shown in FIG. 1 is specially designed for use in connection with a packing machine of the type which is described in Swedish patent application no. 8202302-9. The arrangement comprises a stand 1 which is fixed at an appropriate place on the packing machine. The stand 1 is provided with a roll stand 2 which comprises a shaft 3 projecting laterally from the stand 1 upon which is placed the material roll 4 of striplike material web 5. The shaft 3 also has a brake drum 6 with an external cylindrical surface which preferably is located between the material roll 4 and the stand 1. The material roll 4 is applied to the shaft 3 in a rigid manner by means not shown on the drawing, whereas the shaft is supported so that it can freely rotate in the stand 1.

The stand 1 also carries a brake arrangement 7 for the material web 5. The brake arrangement 7 comprises a maneuvering arm 8 which is suspended pivotably on a point of support 9 which is constituted of a shaft projecting at right angles from the stand 1. The point of support 9 for the maneuvering arm 8 is located at some distance from the shaft 3 and at substantially the same level. From the point of support 9 the maneuvering arm extends downwards with a substantially vertical primary arm 8', to the lower end of which is connected a secondary arm 8''. The secondary arm 8'' of the maneuvering arm 8 extends substantially horizontally from the primary arm 8' and carries at its free end one or more guide pulleys 10 for the material web 5. Above the guide pulleys 10 there are a number of further guide pulleys 11 which are supported so that they can freely rotate on stub shafts projecting laterally from the stand 1. The material web travels from the roll 4 alternately over the guide pulleys 10 and 11 and further to the packing machine, which will be explained in more detail below.

The substantially horizontal secondary arm 8'' of the maneuvering arm 8 has on its end joined to the primary arm 8' one or more substantially vertical leaf springs 12, which at their upper end carry a brake appliance 13 in form of a roller supported so that it is freely rotatable, the working surface of which is made of a flexible material and preferably consists of a number of O-rings 14 arranged side by side. The leaf spring 12 thus extends largely parallel along the primary arm 8' of the maneuvering arm 8 and between the point of support 9 and the shaft 3 of the brake drum. The leaf spring 12 here is of such a length that the brake appliance 13 will be located somewhat above the shaft 3 of the brake drum, and the brake appliance 13 and the point of attachment on the spring 12 in the maneuvering arm 8 thus will be located on opposite sides of an imaginary line which connects the point of support 9 of the maneuvering arm 8 with the shaft of rotation 3 of the brake drum 6. At the opposite side of the brake device 13 in relation to the brake drum 6 a backing surface 15 is provided which is located on the primary arm 8' of the maneuvering arm 8 and, more particularly, at the upper end of the same arm component 8'. When the brake appliance 13 is in its inactive position, which is illustrated in FIG. 1, the distance between the brake appliance and the surface of the brake drum 6 and the distance between the brake appliance 13 and the backing surface 15 are substantially equally large, but the respective distance varies as a function of the state of operation of the arrangement, which will be explained in more detail below.

In addition to the components mentioned up to now the arrangement in accordance with the invention also comprises a stopping device 16 in the form of a knee projecting from the stand 1 with an adjustable stop screw, against which the brake appliance 13 can rest. At the opposite or rear side of the stand 1 the arrangement also may be provided with a tension spring 17 which extends from a point of attachment on the upper part of the stand 1 to the maneuvering arm 8 where the lower end of the spring 17 is connected to an attachment 19 projecting from the lower end of the primary arm 8'.

When the unwinding arrangement in accordance with the invention is used, for example for providing a packing machine of known type with a longitudinally jointed strip, the arrangement is connected to the packing machine in such a manner that the longitudinally jointed strip or material web 5 can be unwound directly from the roll stand 2 via the guide pulleys 11 and 10. The unwinding generally takes place at considerably varying speed, and during the process the material web 5 will be subjected to greater or lesser tractive stresses, that is to say, it will be stretched or slackened to a greater or lesser degree, which via the guide pulleys 10 affects the position of the maneuvering arm 8.

When the material web 5 is unwound at substantially continuous speed, the material roll 4 will adapt to this and rotate at uniform speed with low unwinding resistance. The weight and lever length of the maneuvering arm 8 are adapted so that the material web 5 when it travels alternately over the guide pulleys 10 and 11 is capable of maintaining the maneuvering arm 8 substantially horizontal, which means that the brake appliance 13 is in a free position at a distance from the external surface of the brake drum 6 as well as from the backing surface 15 on the primary arm 8' of the maneuvering arm 8. The brake appliance 13 here has no braking function, and the brake drum 6 with the material roll 4 placed on the shaft 3 can rotate freely at the rate of the material web 5 being rolled off the roll.

Figure 3:
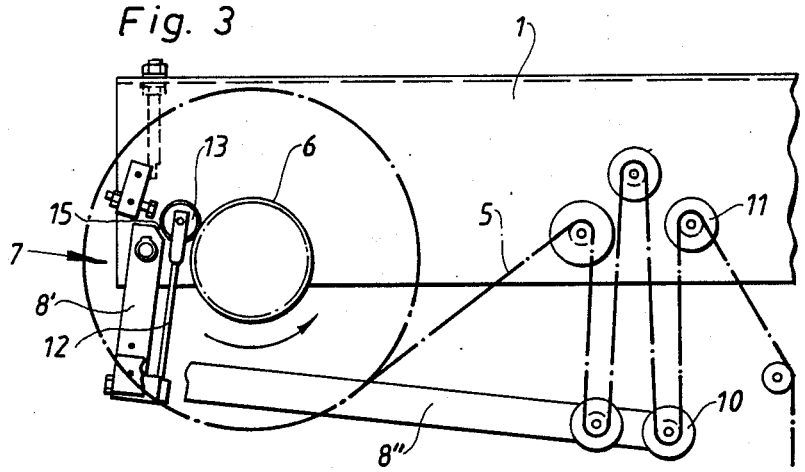
FIG. 3 is a side view of the unwinding arrangement during application of a light braking force.

When the speed of unwinding of the material web is slightly reduced, the material web 4, owing to its inertia, will rotate a little too fast so that a certain excess of the material web 5 is wound off, which means that the web slackens so that the maneuvering arm by its weight is pivoted downwards (clockwise) around its point of support 9, and the vertical distance between the guide pulleys 10 and the guide pulleys 11 increases. As is shown in FIG. 3 this implies that the leaf spring 12 pivots the brake appliance 13 so that it makes contact against the external surface of the brake drum 6, whereby the brake appliance commences to rotate while at the same time deforming the O-rings 14. This means that a light roll resistance is obtained so that the shaft 3 is braked and the rate of rotation of the material roll is reduced. The size of the roll resistance is a function of the web tension, and when the web tension is reduced further, the leaf spring 12 will press the brake appliance 13 with greater force against the brake drum 6 so that the deformation of the O-rings 14, and consequently the roll resistance, increase.

Figure 4:
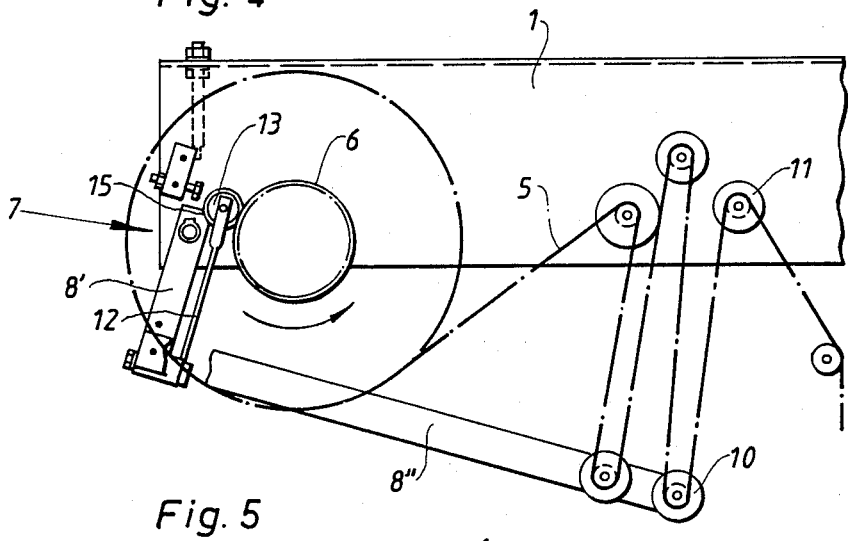
FIG. 4 is a side view of the unwinding arrangement during application of a strong braking force.

When the packing machine is halted, or the consumption of material web 5 for some other reason suddenly ceases or is greatly reduced, the maneuvering arm 8 will rapidly pivot further clockwise to the position shown in FIG. 4, where the brake appliance 13 is pulled downwards by the leaf spring 12 between the brake drum 6 and the upper end of the primary arm 8', so that it makes contact not only against the external surface of the brake drum 6 but also against the backing surface 15 on the maneuvering arm 8. The rotation of the brake appliance 13 will be braked further thereby, so that a strong brake effect is obtained on the brake drum 6. Since the distance between the nearest parts of the brake drum 6 and the backing surface 15 is smaller than the diameter of the brake appliance 13, it is possible through appropriate sloping and shaping of the backing surface 15 in practice for the brake appliance 13 to be wedged up completely between the backing surface 15 and the external surface of the brake drum 6, thus bringing about a locking of the brake drum, so that the material roll altogether cannot rotate. This is promoted further by the fact that the material roll 4 normally rotates anticlockwise and thus on contact with the brake appliance 13 endeavours to move the same downwards towards the wedged up position. In this way any unrolling of superfluous material web and damages to the material web 5 in the event of sudden stoppage of the machine are effectively prevented.

When the machine is started again, and material web 5 is being consumed, the tractive tension in the material web will increase until the guide pulleys 10 are lifted upwards and the maneuvering arm 8 swings anticlockwise again, whereby the brake appliance 13 is lifted from its engagement with the backing surface and reverts to the normal operating position, which varies between light contact against the brake drum 6 (FIG. 3) and the free position shown in FIG. 1.

Figure 5:
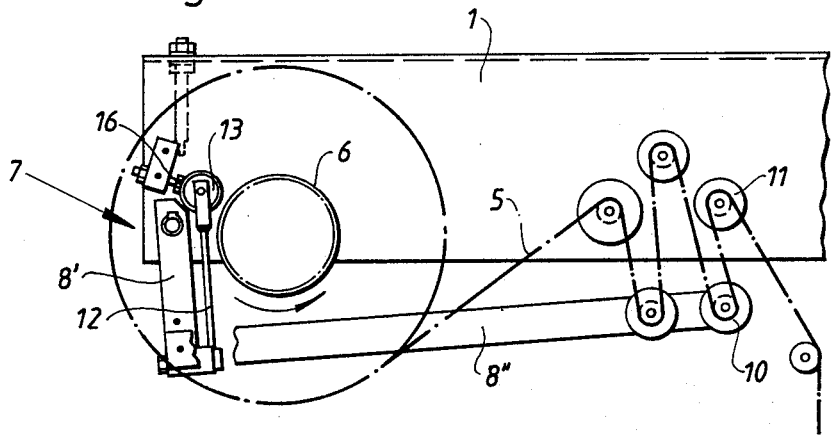
FIG. 5 is a side view of the unwinding arrangement during gentle braking of the maneuvering arm.

If a sudden increase in the speed of the material web 5 occurs, this means that the web tension lifts the guide pulleys 10 to an upper position shown in FIG. 5. When this happens the brake appliance 13 comes into contact with the stopping device 16 which via the leaf spring 12 successively increases the resistance of the maneuvering arm 8 against further anticlockwise pivoting, so that the pivoting of the maneuvering arm 8 is braked gently before the arm attains its mechanical stop position, as a result of which jerks or uncontrolled tractive stresses in the material web are avoided. When the speed of rotation of the material roll 4 increases, the web tension will be successively reduced, whereby the maneuvering arm 8 pivots again clockwise to the normal operating position.

Figure 2:
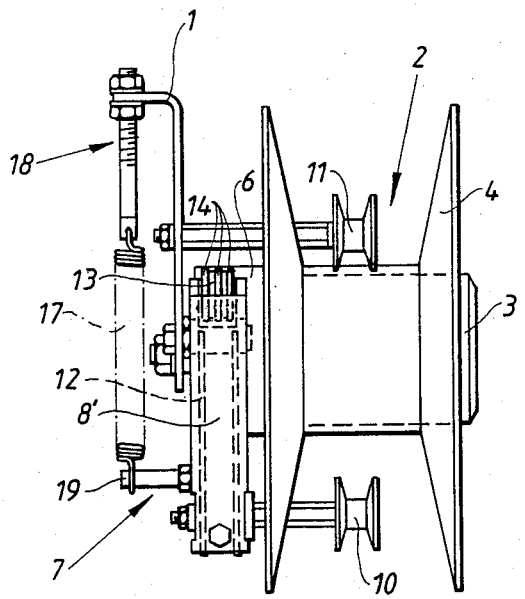
FIG. 2 is a rear view of the arrangement in accordance with FIG. 1.

When the arrangement in accordance with the invention is used in connection with specially thin and delicate types of material webs, or when relatively large and heavy material rolls 4 are used, the arrangement can be made more effective and quicker to react to sudden reductions in the web tension, with the help of the tension spring 17 which endeavours to act upon the maneuvering arm making it move clockwise from the central position. The tension spring 17 is clamped between the tension arrangement 18 and the attachment 19 so that under normal operating conditions (FIG. 1, FIG. 2) it is substantially straight in front of the point of support 9 of the arm. When, in the event of a sudden reduction in the web tension, the maneuvering arm 8 is pivoted clockwise, the centre of the spring 17 will be shifted to the left of the point of support 9 and increase the pivoting movement of the arm 8 in the direction towards the braking or locking position (FIG. 4). Large rolls too are braked effectively in this manner, so that any stresses upon the web can be further reduced.

What is claimed is:

1. Unwinding apparatus for a material web comprising a roll stand, a maneuvering arm having an end acted upon by said material web, means mounting the arm on the roll stand for movement in response to tension in the material as it unwinds from the roll stand, brake means including a braking surface and a brake drum, and roller means for applying the braking surface to retard the brake drum in response to a reduction in tension in the material web as it unwinds, said maneuvering arm being supported on said roll stand at a point of support, said point of support located on a side of said brake drum that faces away from said end of the maneuvering arm acted upon by said material web.

2. An arrangement in accordance with claim 1, wherein said braking surface is located at a distance from the brake drum that is smaller than the diameter of the roller means.

3. An arrangement in accordance with claim 2, wherein the roller means is movable by means of said maneuvering arm between a first position a distance from the brake drum, a second position causing contact with the brake drum and a third position causing contact with the brake drum and with the braking surface.

4. An arrangement in accordance with claim 1, wherein the roller means is supported flexibly by the maneuvering arm.

5. An arrangement in accordance with claim 1, wherein the maneuvering arm has a primary arm extending substantially downwards from the point of support and a secondary arm which extends at an angle to said primary arm, a spring supporting the roller means, said spring extending along the primary arm between the point of support of the maneuvering arm and a rotation shaft of the brake drum.

6. An arrangement in accordance with claim 5, wherein the roller means and a point of attachment of the spring in the maneuvering arm are located on both sides of a line which connects the point of support of the maneuvering arm with the rotational shaft of the brake drum.

7. An arrangement in accordance with claim 2, wherein the braking surface is located on a side of the point of support of the maneuvering arm that faces away from a part of the maneuvering arm that is in contact with the material web.

8. An arrangement in accordance with claim 1, wherein a working surface of the roller means is made of a flexible material.

9. An arrangement in accordance with claim 8, wherein the roller means includes a roller having O-rings disposed thereon.

10. Unwinding apparatus for a material web comprising a base, a rotary shaft on the base for mounting a spool containing a material web, a maneuvering arm mounted on said base for swinging movement about a first axis, pulleys on said arm and on said base for guiding a web as it unwinds from the spool, said pulleys being arranged to swing said arm in a first direction as tension in the web increases, said arm being mounted to swing in a direction opposite to said first direction in response to gravity as tension in the web decreases, said arm including a braking surface adjacent said rotary shaft, a brake drum on said shaft, said arm also having a roller between said braking surface and said brake drum, said braking surface being positioned on said arm to move away from said drum upon movement of said arm in said first direction and toward said drum upon movement in the opposite direction, said roller being arranged to engage the braking surface and the drum to retard the rotation of the drum when the tension in the web decreases.

11. The unwinding apparatus of claim 10 wherein said arm includes a first segment extending downwardly relative to said shaft and a second segment extending outwardly from said first segment, said pulleys being spaced from said shaft.

* * * * *